US009073559B2

(12) United States Patent
Kilian et al.

(10) Patent No.: US 9,073,559 B2
(45) **Date of Patent: *Jul. 7, 2015**

(54) SYSTEM AND METHOD FOR MONITORING CONDITION OF RAIL CAR WHEELS, BRAKES AND BEARINGS

(71) Applicant: LynxRail Corporation, Colorado Springs, CO (US)

(72) Inventors: Krzysztof Kilian, Colorado Springs, CO (US); Vladimir Mazur, Floreat (AU)

(73) Assignee: LynxRail Corporation, Colorado Springs, CO (US)

( * ) Notice: Subject to any disclaimer, the term of this patent is extended or adjusted under 35 U.S.C. 154(b) by 146 days.

This patent is subject to a terminal disclaimer.

(21) Appl. No.: 13/725,233

(22) Filed: Dec. 21, 2012

(65) Prior Publication Data

US 2013/0175406 A1 Jul. 11, 2013

Related U.S. Application Data

(63) Continuation of application No. 12/844,418, filed on Jul. 27, 2010, now Pat. No. 8,439,315.

(60) Provisional application No. 61/229,582, filed on Jul. 29, 2009.

(51) Int. Cl.

| | |
|---|---|
| ***B61K 9/04*** | (2006.01) |
| ***B61K 9/06*** | (2006.01) |
| ***B61K 9/12*** | (2006.01) |

(52) U.S. Cl.

CPC ... *B61K 9/06* (2013.01); *B61K 9/04* (2013.01); *B61K 9/12* (2013.01)

(58) Field of Classification Search

USPC ..... 246/167 R–169 S

See application file for complete search history.

(56) References Cited

U.S. PATENT DOCUMENTS

| | | | |
|---|---|---|---|
| 3,697,744 | A | 10/1972 | Howell |
| 3,767,146 | A | 10/1973 | Gallagher |

(Continued)

FOREIGN PATENT DOCUMENTS

| | | | |
|---|---|---|---|
| EP | 0041178 | A1 | 12/1981 |
| EP | 1407162 | B1 | 4/2005 |

(Continued)

OTHER PUBLICATIONS

International Search Report and Written Opinion of the International Search Authority mailed Sep. 28, 2010, in International Appln. No. PCT/US10/043379.

(Continued)

*Primary Examiner* — R. J. McCarry, Jr.

(74) *Attorney, Agent, or Firm* — Boardman & Clark LLP

(57) ABSTRACT

A system and method for detecting failing rail car wheels, brakes, bearings, and/or other components of a rail car may include at least one thermal sensor and at least one image capture device. The thermal sensor(s) and image capture devices(s) are usable to help determine whether there is a failure or potential failure of a component of a wheel set by detecting, measuring and/or comparing a temperature of various portions of the wheel set. If the temperature is higher than expected, it may indicate, for example, a stuck brake, a failing bearing, and/or some other failure of the wheel set. If the temperature is lower than expected, it could indicate that a brake of the wheel set is unexpectedly disengaged and/or some other failure of the wheel set.

11 Claims, 2 Drawing Sheets

(56) References Cited

U.S. PATENT DOCUMENTS

| | | | | |
|---|---|---|---|---|
| 3,978,712 | A | 9/1976 | Cowan | |
| 4,323,211 | A | 4/1982 | Bambara | |
| 4,659,043 | A | 4/1987 | Gallagher | |
| 5,331,311 | A * | 7/1994 | Doctor | 340/463 |
| 5,448,072 | A | 9/1995 | Gallagher | |
| 5,660,470 | A | 8/1997 | Mench | |
| 5,677,533 | A | 10/1997 | Yaktine et al. | |
| 5,730,526 | A | 3/1998 | Davis et al. | |
| 6,823,242 | B1 | 11/2004 | Ralph | |
| 6,862,936 | B2 | 3/2005 | Kenderian et al. | |
| 6,955,100 | B1 | 10/2005 | Barich et al. | |
| 8,439,315 | B2 * | 5/2013 | Kilian et al. | 246/167 R |
| 2004/0075570 | A1 | 4/2004 | Bartonek | |
| 2006/0131464 | A1 | 6/2006 | Hesser et al. | |
| 2006/0180760 | A1 | 8/2006 | Lane et al. | |
| 2009/0040503 | A1 | 2/2009 | Kilian et al. | |

FOREIGN PATENT DOCUMENTS

| | | | |
|---|---|---|---|
| EP | 1600351 | A1 | 11/2005 |
| WO | WO 03/008834 | A1 | 1/2003 |

OTHER PUBLICATIONS

Extended European Search Report of the European Patent Office dated Jun. 14, 2013, in International Appln. No. PCT/US10/043379.

* cited by examiner

SYSTEM AND METHOD FOR MONITORING CONDITION OF RAIL CAR WHEELS, BRAKES AND BEARINGS

This application claims priority as a continuation application to U.S. patent application Ser. No. 12/844,418, filed Jul. 27, 2010, which claims the benefit of U.S. Provisional Application 61/229,582, filed Jul. 29, 2009, the contents of which are hereby incorporated by reference in their entirety.

FIELD

This invention relates to a system and method for monitoring condition of rail car components including wheels, brakes and bearings.

BACKGROUND

Rail car brakes are generally fail safe systems. That is, when a portion of the system fails, the brakes are usually applied automatically as a safety precaution. This can result in brakes being applied when not intended. Likewise, if the brakes are set (e.g., calibrated) while the car is heavily loaded and then not reset after unloading, the brakes may be applied when not intended.

Rail car brakes that are applied when not intended or more than necessary or desired are subject to more wear, and reduced life, and may result in earlier failure of the brake and/or other components of the rail car. Additionally, rail car bearings and/or other components of the rail car may fail separately from the rail car brakes. When one or more components of a rail car fail, the result may include an increased or disproportional wear or stress on the rail car wheel and/or its other components, which may result in further components of the rail car or wheel failing.

SUMMARY

An embodiment of this invention relates to a system for monitoring a condition of at least one rail car wheel, at least one rail car brake and/or at least one rail car bearing. The system includes a thermal sensor focused on a top portion of the at least one rail car bearing and an image capture device, wherein the at least one rail car wheel, the at least one rail car brake and/or the at least one rail car bearing are visible in an image captured by the image capture device.

Another embodiment of this invention relates to a system for monitoring a condition of at least one rail car wheel, at least one rail car brake and/or at least one rail car bearing. The system includes a thermal sensor focused on a lower portion of the at least one rail car wheel and an image capture device, wherein the at least one rail car wheel, the at least one rail car brake and/or the at least one rail car bearing are visible in an image captured by the image capture device.

Another embodiment of this invention relates to a method for monitoring the condition of at least one rail car wheel, at least one rail car brake and/or at least one rail car bearing. The method includes measuring the temperature of a top portion of the at least one rail car bearing with a first thermal sensor, measuring the temperature of a portion of the rail car wheel with a second thermal sensor, capturing at least one image of the at least one rail car wheel, the at least one rail car brake and/or the at least one rail car bearing with an image capture device and comparing the measured temperatures and/or the captured image to an expected result or stored data.

These and other features and advantages of various exemplary embodiments of systems and methods according to this invention are described in, or are apparent from, the following detailed descriptions of various exemplary embodiments of various devices, structures and/or methods according to this invention.

DRAWINGS

Various exemplary embodiments of the systems and methods according to this invention will be described in detail, with reference to the following figures, wherein.

Figure 5:
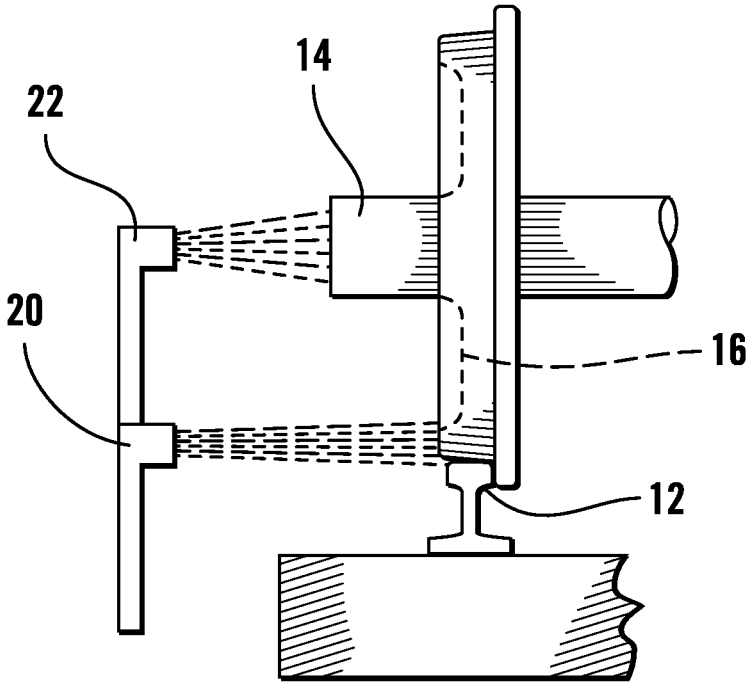
Figure 6:
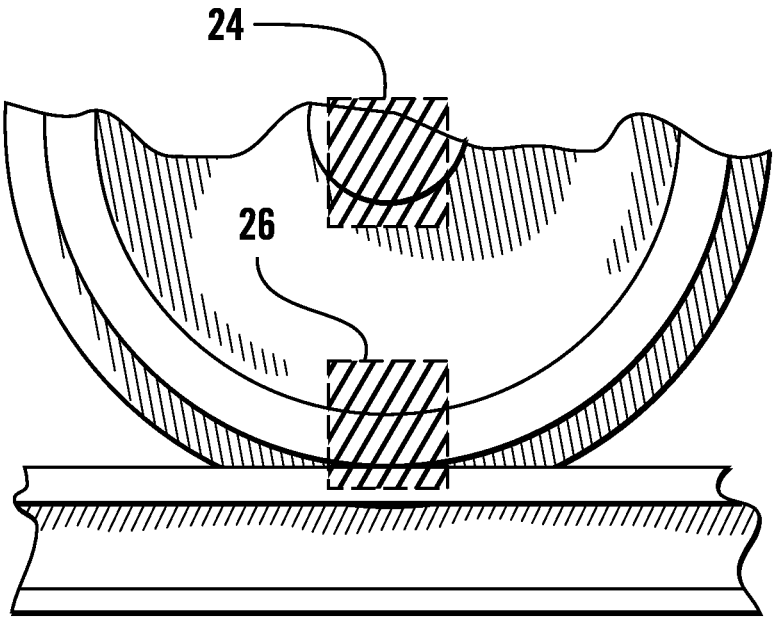

FIG. 5 is a front plan view of a rail car wheel and a system for detecting a failing rail car wheel, a failing rail car brake and/or a failing rail car bearing according to an exemplary embodiment; and FIG. 6 is a side plan view of a portion of a rail car wheel and a system for detecting a failing rail car wheel, a failing rail car brake and/or a failing rail car bearing according to an exemplary embodiment.

DETAILED DESCRIPTION

It should be appreciated that, while portions of this description are outlined as being related to detecting a failing rail car wheel, a failing rail car brake or a failing rail car bearing individually, such systems and methods may be usable together to determine a failing rail car wheel, a failing rail car brake and/or a failing rail car bearing either simultaneously or separately. Likewise, the exemplary embodiments of systems and methods of this invention may be usable for other purposes, such as, for example, departure inspections, arrival inspections and/or the like.

The Federal Railroad Administration (FRA), an administration within the United States Department of Transportation, among other things, enforces rail safety regulations. The FRA currently requires brake shoe inspection on rail cars for every 1,000 miles of travel. These inspections are typically performed by railroad personnel who visually inspect the brakes. These manual, visual inspections can be lengthy and may require that the rail car be slowed, stopped and/or removed from service, at least temporarily.

Figure 1:
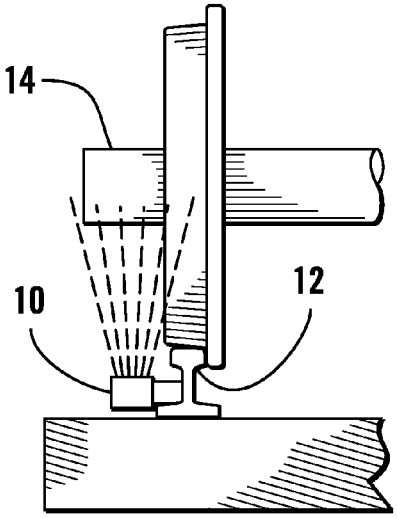
FIG. 1 (Prior Art)
FIG. 1 is a front plan view of a rail car wheel and a known system for helping detect a failed rail car bearing.
Figure 2:
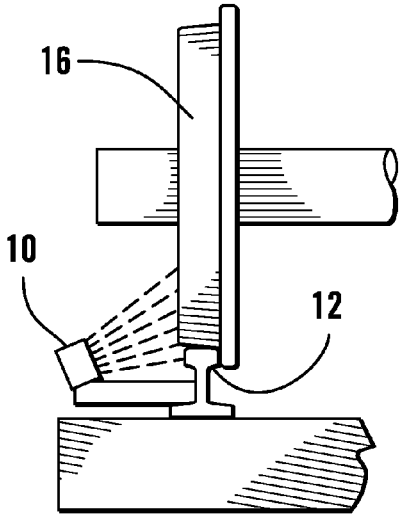
FIG. 2 (Prior Art)
FIG. 2 is a front plan view of a rail car wheel and a known system for helping detect a failed rail car brake.
Figure 3:
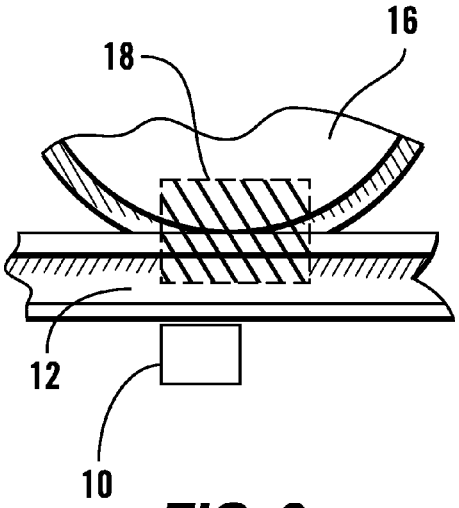
FIG. 3 (Prior Art)
FIG. 3 is a side view of a portion of a rail car wheel and a known system for helping detect a failed rail car wheel.

FIGS. 1-3 show a traditional system for assisting railroad personnel in detecting a failure in a rail car wheel assembly. FIG. 1 shows a traditional system for assisting railroad personnel in detecting a failed rail car bearing. The system includes a thermal sensor 10 (e.g. "hot box") attached to a section of rail 12. Thermal sensor 10 is directed in an upward direction toward a bottom surface of a rail car bearing 14 and measures a temperature of the bottom surface of rail car bearing 14. If the temperature is higher than expected, it may indicate that rail car bearing 14 has failed, is failing or is close to failing.

Likewise, FIG. 2 shows a traditional system for assisting railroad personnel in detecting a failing rail car brake. Thermal sensor 10 is again attached to rail 12 but is now directed toward a wide area of a bottom portion of a rail car wheel 16. Thermal sensor 10 determines whether rail car wheel 16 is hotter or colder than expected as determined by expected conditions of rail car wheel 16 and a rail car brake for rail car wheel 16. An applied rail car brake may generate heat on the rail car wheel to which it is applied and/or may generate heat on a brake shoe of the rail car brake. As such, if rail car wheel 16 is hotter than expected (e.g., thermal sensor 10 detects a temperature that is higher than expected for a given condition), it may indicate that the rail car brake is applied when it should not be. Likewise, if rail car wheel 16 is colder than expected, it may indicate that the rail car brake is not applied when it should be.

In general, in the traditional systems shown in FIGS. 1-3, thermal sensor 10 is directed toward a wide area including and surrounding a wheel/bearing area of a rail car. FIG. 3 shows an exemplary scanning region 18 (located on a bottom portion of rail car wheel 16) of thermal sensor 10 of the known systems. As shown in FIG. 3, scanning region 18 is considerably large in comparison to the size of rail car wheel 16. As such, thermal sensor 10 must average a detected temperature over a large region to determine the perceived temperature of rail car wheel 16. It should be appreciated that a considerably large portion of rail 12 may also be within scanning region 18 and as such, the temperature of rail 12 also affects the perceived temperature of wheel 16 as determined by thermal sensor 10. Similarly, the perceived temperature determined by thermal sensor 10 may be affected by any foreign object, including, for example, the rail car itself or other portions thereof that are present in scanning region 18.

The known systems shown in FIGS. 1-3 experience several disadvantages. For example, since thermal sensor 10 is attached to rail 12, thermal sensor 10 may experience a dynamic environment, e.g., changing conditions due to changes in track parameters such as temperature, vibrations, etc., and thus the accuracy of such systems may be diminished due to the unpredictable nature of the dynamic environment. Additionally, the dynamic environment may cause increased stress due to, for example, increased vibrations and/or elevated temperatures to the thermal sensor and may shorten the expected life span of the thermal sensor.

Likewise, the known systems may have a scanning area (e.g., scanning region 18) that is relatively large (e.g., as wide as two feet or more). The scanning area of the known systems must then be averaged, which may result in a less accurate reading that does not account for small local changes in temperature. For example, if the rail car or the rail on which it is riding are hotter than expected for any reason, and a portion of the rail car and/or the rail on which it is riding, with its elevated temperature, is within the scanning area of a thermal sensor of the known system, then the averaged temperature determined by the thermal sensor may be higher than expected despite the temperature of the rail car wheel and/or rail car bearing possibly not being higher than expected.

Further, the known systems for detecting a failing bearing, having a thermal sensor that is attached to the rail, are directed toward the bottom surface of the rail car bearing. It has been found that the bottom surface of the bearing is generally cooler than a top portion, sometimes referred to as the "Loading Zone," where forces from the side frames are transferred to the wheel axles. By measuring the top portion of the bearing, as outlined in the exemplary embodiments below, compromised or failing bearings may be identified more readily and/or earlier which may result in earlier warning prior to a failed or near failed bearing.

Furthermore, rail car bearings are generally cylindrical in shape. As such, the known systems, which are directed toward the bottom surface of a rail car bearing, may not be able to precisely detect the temperature of the rail car bearing. The known systems measure temperatures as if on a flat surface and the measurements are typically required to be calibrated or adjusted to correct for the cylindrical shape of the rail car bearing. As a result of the correction, the final calculation may be an approximation rather than a more reliable direct reading.

Figure 4:
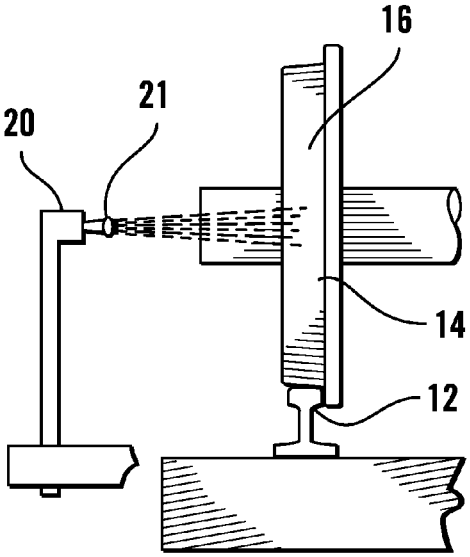
FIG. 4 is a front plan view of a rail car wheel and a system for helping detect a failing rail car bearing according to an exemplary embodiment.

FIGS. 4-6 show exemplary embodiments of systems that may assist railroad personnel in detecting failing components of a rail car. Alternatively, the below-outlined systems may be usable separate from any inspection by railroad personnel. For example, various embodiments of the below-outlined systems may be utilized while a rail car is in motion (e.g., at speed). It should be appreciated that, by reducing the time and/or personnel necessary to inspect a rail car, the overall cost of these inspections may be reduced. Additionally, the below-outlined and other embodiments may allow for a complete or initial inspection of a rail car set to be completed without stopping the rail car or removing the rail car from service. In various embodiments, the complete or initial inspection may be conducted at speed without the rail car being significantly slowed. The below-outlined and other embodiments may be utilized, either separately or in addition to inspections by railroad personnel, to satisfy the necessary 1,000 mile inspections and/or any other inspections required by the FRA or that are otherwise desirable.

FIG. 4 illustrates a rail car wheel and a system adapted for detecting a failing rail car bearing according to an exemplary embodiment. The exemplary embodiment shown in FIG. 4 includes a first thermal sensor 20 provided and supported separately from a first rail 12, and directed toward a first portion (e.g., top portion) of a rail car bearing 14. In one or more examples of embodiments, and as shown in FIG. 4, first thermal sensor 20 is provided adjacent first rail 12 at a first location above first rail 12. In various embodiments, first sensor 20 is provided at a wayside location. In various embodiments, first sensor 20 is a sensor that may be utilized to acquire temperature readings and other information rapidly so rail car may be moving during the process. In various embodiments, first thermal sensor 20 includes or otherwise utilizes a focusing lens 21 or is focused in any other known or later-developed manner. By directing first thermal sensor 20 in a focused or more precise manner toward the top portion or surface of the rail car bearing 14, the system may detect or be utilized to detect, determine or measure a failing rail car bearing earlier than known systems. Additionally, by helping focus the thermal sensor on a relatively smaller or more precise area, background temperature sources that are known to lead to less accurate readings (e.g., sources that radiate heat that are not the desired target of the sensor and/or system, such as, for example, heat from a rail or heat from a rail car) may be eliminated, avoided or ignored. This has been found to help reduce false readings, and/or improve the accuracy of actual readings, which may result in a premature determination that the rail car bearing was failing or near failing and/or may cause unnecessary stoppages or delays associated with further inspections.

FIG. 5 shows a system for detecting a failing rail car wheel, brake and/or bearing according to an exemplary embodiment. As shown in FIG. 5, first thermal sensor 20 and a second thermal sensor 22 are provided on the field side (e.g., a side of a rail furthest from an opposing rail) of first rail 12. In one or more examples of embodiments, and as shown in FIG. 5, first thermal sensor 20 and second thermal sensor 22 are each provided adjacent first rail 12 at a first location above first rail 12. The system may use rapid temperature acquisition sensors so rail cars may be moving during process. First thermal sensor 20 and second thermal sensor 22 are focused and directed at areas 24 and 26, shown in FIG. 6, at or about the top of bearing 14 and at or about the bottom edge (i.e., a section of the edge of wheel 16 including at least some of the portion of the edge of wheel 16 in contact with a top of the first rail 12) of wheel 16, respectively. By focusing a thermal sensor or sensors more precisely (e.g., toward a top of a bearing of a rail car wheel), a failure of the bearing or conditions indicating or leading to a future failure may be identified earlier, which may provide more notice before the bearing fails and/or may result in less wear associated with a failed or failing bearing on the other components of the rail car wheel.

For example, a failed or failing rail car bearing may cause a rail car wheel to wear unevenly, which may result in the rail car wheel failing sooner than when being worn evenly. By identifying a failed, failing or otherwise compromised bearing sooner, the uneven wearing of the rail car wheel may be detected earlier, which may result in a longer or more optimal life span of the rail car wheel and/or any other components of the rail car wheel. Additionally, a rail car wheel that is wearing unevenly may indicate other problems with the rail car that can be identified and corrected earlier if the unevenly wearing wheel is identified earlier.

Similar to how a failing bearing is identified in the above-outlined and other embodiments, a higher- or lower-than-expected temperature of a rail car wheel may indicate a failing rail car brake or other component of a rail car. For example, if the temperature determined by either or both of first thermal sensor 20 and second thermal sensor 22 is elevated, and it is known that a rail car brake of rail car wheel 16 is not intentionally applied, the elevated temperature may indicate that the rail car brake is stuck or being inadvertently applied due to a failed component, improper calibration or other factor. In various embodiments, the operator of the rail car may be notified of the condition and further inspections may be performed.

In an exemplary embodiment, a first thermal sensor, such as, for example, an infrared sensor, is positioned adjacent a rail and measures a temperature of that rail and/or of a rail car wheel as the rail car passes the first sensor. For example, the first thermal sensor may be provided within a relatively long, straight portion of the rail (e.g., two miles or more without significant turns). The first thermal sensor may then be able to measure a base reading of the temperature of the rail car wheel and/or rail when the rail car brakes are not applied and have not been applied for a sufficient length of time. This base temperature can then be compared to a temperature of the rail car wheel at a later section of the track, while the brakes are applied.

It should be appreciated that, in various embodiments, multiple factors may cause elevated temperatures of a rail car wheel, such as, for example, a sliding wheel, a stuck brake, a worn brake, an improperly calibrated brake, a failed or failing bearing, etc. In various embodiments, several factors that contribute to elevated rail car wheel temperature may be identified by different heat signatures or heat patterns on the rail car wheel. For example, a sliding wheel may have an elevated temperature near a contact region between the rail car wheel and a rail, at least in comparison to a properly operating wheel. In contrast, a stuck brake may cause an elevated temperature of the rail car wheel near the rail car brake, at least in comparison to a rail car wheel with a properly working rail car brake. In various embodiments, the difference in heat signatures may be used, at least in part, to identify what, if any, component has failed or is failing.

In various embodiments, the heat signature and/or temperatures determined by a first and/or second thermal sensor are utilized with one or more images (e.g., video or still images) captured by an image capturing device. The images may include at least a portion of the rail car wheel, at least a portion of the rail car brake and/or at least a portion of the rail car bearing or end cap monitored or measured by one or more thermal sensors and may help assist a user in evaluating the status or condition of the rail car wheel, the rail car brake and/or the rail car bearing. For example, in various embodiments, the image may be used, at least in part, to help determine a position of a brake shoe of the rail car. By determining the position of the brake shoe, it can be determined whether an elevated temperature detected by the thermal sensor(s) coincides with (e.g., is the result of) application of the brake shoe to the rail car wheel.

In various embodiments, one or more images may be utilized with thermal sensor measurements or determinations to improve the accuracy of the system. For example, one or more images may be utilized to determine or approximate the distance between a brake shoe and surface of a wheel.

In various embodiments, multiple systems including one or more thermal sensors and/or one or more image capturing devices may be utilized to further improve the accuracy of monitoring, measurements and determinations. For example, determinations from multiple systems may be provided for comparison and/or improved accuracy.

In various embodiments, one or more thermal scans and/or images of one or more rail cars moving at a speed where brake shoes would not normally be applied are obtained. In various embodiments, one or more additional thermal scans of the same rail cars would then be obtained when the rail cars are moving at a speed where the brakes would normally be applied, and one or more images of the braking equipment and wheels are obtained at or about the same time. In various embodiments, the one or more images would also be obtained to help determine or approximate the distance between a brake shoe and the running surface of the wheel. By comparing the scans and distances obtained, the system may be utilized to establish the efficiency of the brake equipment on one or more individual wheels. This method (either using temperature measurements alone, or combining temperature measurements with one or more images) may be utilized to help perform an audit on the brake equipment of rail cars in a way that it will fulfill the requirements of the F.R.A. 1000 mile inspection.

FIG. 6 shows an exemplary embodiment of scanning areas 24 and 26. As shown in FIG. 6, scanning areas 24 and 26 are smaller or more precise in comparison to the size of the rail car wheel than in known systems (e.g., in comparison to scanning area 18). The reduced size of scanning areas 24 and 26 in comparison to, for example, scanning area 18 shown in FIG. 3, allows for more accurate and precise temperature sensing by first thermal sensor 20 and/or second thermal sensor 22. For example, by honing the scanning areas, background interference or other data that may affect readings may be reduced.

Further, because the first and second thermal sensors are not attached to the rail, as in previous systems, the first and second thermal sensors may not be subject to the wear and tear associated with the vibrations and other forces felt by the rail. Furthermore, the thermal sensors may not be affected by the dynamic environment on and/or around the rail. This may result in an improved accuracy and/or an increased longevity of the thermal sensors.

A system and method for detecting failing rail car wheels, brakes and/or bearings includes at least one focused thermal sensor and at least one image capturing device. The thermal sensor(s) and image capture device(s) help determine whether there is a failure or potential failure with a wheel set of a rail car by detecting, measuring and/or comparing the temperature of various portions of the wheel set. If the temperature is higher than expected, it could be indicative of a sticking brake, a failing bearing or some other failure of the wheel set. If the temperature is lower than expected, it could be indicative of an unexpectedly unapplied brake or some other failure of the wheel set.

While this invention has been described in conjunction with the exemplary embodiments outlined above, various alternatives, modifications, variations, improvements and/or substantial equivalents, whether known or that are or may be presently foreseen, may become apparent to those having at least ordinary skill in the art. Accordingly, the exemplary embodiments of the invention, as set forth above, are intended to be illustrative, not limiting. Various changes may be made without departing from the spirit or scope of the invention. Therefore, the invention is intended to embrace all known or earlier developed alternatives, modifications, variations, improvements and/or substantial equivalents.

The invention claimed is:

1. A method of assisting in a determination of a condition of at least a component of a rail car in motion, the method comprising:

using a focusing lens to focus a first thermal sensor, which first thermal sensor is provided adjacent a first rail at a first location above the first rail, about a top of a bearing of a rail car;

detecting, with the first thermal sensor, a first temperature of the top of the bearing of the rail car;

comparing the detected first temperature of the top of the bearing to at least one other temperature to determine a difference between the detected first temperature of the top of the bearing and the at least one other temperature; and determining whether at least one component of the rail car is failing using the difference between the detected first temperature of the top of the bearing and the at least one other temperature.

2. The method of claim 1, further comprising capturing a photographic image of at least a portion of a wheel of the rail car with a first image capture device provided adjacent the first rail at the first location.

3. The method of claim 1, wherein comparing the detected first temperature of the top of the bearing to at least one other temperature comprises comparing the first detected temperature of the top of the bearing to an expected temperature.

4. The method of claim 1, further comprising:

detecting, with a second thermal sensor provided adjacent the first rail at the first location above the first rail, a first temperature of a bottom edge of a wheel of the rail car;

comparing the detected first temperature of the bottom edge to at least one other temperature to determine a difference between the detected first temperature of the bottom edge and the at least one other temperature; and determining whether at least one component of the rail car is working properly using the difference between the detected first temperature of the bottom edge and the at least one other temperature.

5. The method of claim 4, wherein comparing the detected first temperature of the bottom edge to at least one other temperature comprises comparing the detected first temperature of the bottom edge with a second temperature of the bottom edge taken at a another section of the rail.

6. The method of claim 4, wherein detecting the first temperature of the bottom edge of the wheel of the rail car further comprises detecting the first temperature at a location along the rail that is sufficiently straight such that the brake of the wheel will not have been recently applied.

7. The method of claim 4, wherein detecting the first temperature of the bottom edge of the wheel of the rail car comprises focusing the second wheel thermal sensor with a focusing lens.

8. A method of assisting in a determination of a condition of at least a component of a rail car in motion, the method comprising:

using a focusing lens to focus a first thermal sensor, which first thermal sensor is provided adjacent a first rail at a first location above the first rail, on a first portion of a bearing of a rail car;

detecting, with the first thermal sensor, a first temperature of the first portion of the bearing of the rail car;

comparing the first temperature of the first portion to at least one other temperature to determine a difference between the first temperature of the first portion and the at least one other temperature;

determining whether at least one component of the rail car is failing using the difference between the first temperature of the first portion and the at least one other temperature;

detecting, with a second thermal sensor provided adjacent the first rail at the first location above the first rail, a first temperature of a bottom edge of a wheel of the rail car;

comparing the first temperature of the bottom edge to at least one other temperature to determine a difference between the first temperature of the bottom edge and the at least one other temperature;

determining whether at least one component of the rail car is working properly using the difference between the first temperature of the bottom edge and the at least one other temperature; and capturing an image of at least a portion of the wheel of the rail car to determine a position of a brake shoe of the wheel.

9. A method of assisting in a determination of a condition of at least a component of a rail car in motion, the method comprising:

using a focusing lens to focus a first thermal sensor, which first thermal sensor is provided adjacent a first rail at a first location above the first rail, on a first portion of a bearing of a rail car;

detecting, with the first thermal sensor, a first temperature of the first portion of the bearing of the rail car;

comparing the first temperature of the first portion to at least one other temperature to determine a difference between the first temperature of the first portion and the at least one other temperature;

determining whether at least one component of the rail car is failing using the difference between the first temperature of the first portion and the at least one other temperature;

detecting, with a second thermal sensor provided adjacent the first rail at the first location above the first rail, a first temperature of a bottom edge of a wheel of the rail car;

comparing the first temperature of the bottom edge to at least one other temperature to determine a difference between the first temperature of the bottom edge and the at least one other temperature;

determining whether at least one component of the rail car is working properly using the difference between the first temperature of the bottom edge and the at least one other temperature; and determining whether at least one component of the rail car is working properly comprises determining whether the difference between the first temperature of the bottom edge and the expected operating temperature is caused by an applied brake shoe based on the capture image;

wherein comparing the first temperature of the bottom edge to at least one other temperature comprises comparing the first temperature to an expected operating temperature of the wheel of the rail car.

10. A method of assisting in a determination of a condition of at least a component of a rail car in motion, the method comprising:

using a focusing lens to focus a first thermal sensor, which first thermal sensor is provided adjacent a first rail at a first location above the first rail, on a first portion of a bearing of a rail car;

detecting, with the first thermal sensor, a first temperature of the first portion of the bearing of the rail car;

comparing the first temperature of the first portion to at least one other temperature to determine a difference between the first temperature of the first portion and the at least one other temperature;

determining whether at least one component of the rail car is failing using the difference between the first temperature of the first portion and the at least one other temperature;

detecting, with a second thermal sensor provided adjacent the first rail at the first location above the first rail, a first temperature of a bottom edge of a wheel of the rail car;

comparing the first temperature of the bottom edge to at least one other temperature to determine a difference between the first temperature of the bottom edge and the at least one other temperature;

determining whether at least one component of the rail car is working properly using the difference between the first temperature of the bottom edge and the at least one other temperature; and capturing an image of at least a portion of the wheel of the rail car to determine a position of a brake shoe of the wheel;

wherein comparing the first temperature of the bottom edge to at least one other temperature comprises comparing the first temperature of the bottom edge to an expected temperature.

11. The method of claim 10, wherein determining whether at least one component of the rail car is working properly comprises determining that at least one component is potentially failing if the first temperature of the bottom edge is less than a predetermined minimum threshold above the expected temperature.

* * * * *